United States Patent [19]

Finsterwalder

[11] 3,985,480

[45] Oct. 12, 1976

[54] APPARATUS FOR THE SECTIONAL CANTILEVER CONSTRUCTION OF BRIDGE GIRDER SYSTEMS

[75] Inventor: Klemens Finsterwalder, Ahornweg, Germany

[73] Assignee: Dyckerhoff & Widmann AG, Munich, Germany

[22] Filed: Apr. 10, 1975

[21] Appl. No.: 566,709

Related U.S. Application Data

[63] Continuation of Ser. No. 389,618, Aug. 17, 1973, abandoned.

[30] Foreign Application Priority Data

Aug. 18, 1972 Germany ..... 2240678

[52] U.S. Cl. ..... 425/63; 249/20

[51] Int. Cl.[2] ..... E01D 1/00; B28B 23/02

[58] Field of Search ..... 425/62–65; 249/20, 22; 164/33–34; 14/1

[56] References Cited

UNITED STATES PATENTS

| | | | |
|---|---|---|---|
| 2,963,764 | 12/1960 | Finsterwalder | 264/34 |
| 3,003,219 | 10/1961 | Suter et al. | 264/33 |
| 3,299,191 | 1/1967 | Mantscheff et al. | 14/1 |
| 3,425,076 | 2/1969 | Finsterwalder | 264/33 |
| 3,490,605 | 1/1970 | Koss | 264/34 |
| 3,571,835 | 3/1971 | Buechler | 425/63 |
| 3,579,759 | 5/1971 | Zuccolo | 425/62 |

FOREIGN PATENTS OR APPLICATIONS

| | | | |
|---|---|---|---|
| 221,133 | 10/1961 | Austria | 14/1 |
| 1,454,734 | 10/1966 | France | 14/1 |
| 1,236,546 | 1/1963 | Germany | 14/1 |
| 630,671 | 12/1961 | Italy | 14/1 |

*Primary Examiner*—Robert D. Baldwin
*Assistant Examiner*—John McQuade
*Attorney, Agent, or Firm*—Frank L. Durr; Orville N. Greene

[57] ABSTRACT

There is disclosed apparatus for the sectional cantilever construction of bridge girder systems of reinforced or prestressed concrete having a superstructure comprising a closed box cross-section and superimposed laterally overhanging bridge decking, said apparatus comprising travel devices for abutting against an already finished part of the bridge superstructure at whose position fixed support members, e.g. hydraulic jacks are disposed during the concreting operation, longitudinal girders projecting in the concreting condition over the front end of said finished superstructure part and connected to said travel devices or fixed supports therefor; shuttering components, for a cantilever section, carried by said girders; and half-frames engaging laterally round said bridge deck and having means for supporting on said bridge deck; the apparatus being further characterized by said longitudinal girders being arranged laterally outside the shuttering for the side walls of the superstructure and being connected with outer shuttering made inherently rigid and self-supporting; by said half-frames being connected (in such a way as to be rigidly resistant to bending) to longitudinal girders substantially at the rearward ends of said shuttering; by said longitudinal girders being provided at the side opposite the part which is projecting and which carries said shuttering with devices for abutting against or supporting the underside of said laterally overhanging bridge deck. There is also disclosed an auxiliary structure for use with such apparatus.

16 Claims, 15 Drawing Figures

APPARATUS FOR THE SECTIONAL CANTILEVER CONSTRUCTION OF BRIDGE GIRDER SYSTEMS

This is a continuation, of application Ser. No. 389,618, filed Aug. 17, 1973, now abandoned.

FIELD OF THE INVENTION

The invention is particularly applicable to apparatus for the sectional cantilever construction of bridge girder systems of reinforced or prestressed concrete comprising a closed box cross-section and superimposed laterally overhanging bridge decking.

DESCRIPTION OF THE PRIOR ART

For producing bridge girder systems of prestressed concrete, appliances termed "cantilever construction crabs" are known from German Patent Specification No. 973 407 which can be conveyed with traversing mechanisms either directly or via rails on the deck of one already finished bridge part, overhang this bridge part and carry in this overhanging part, on a working platform arranged below the bridge superstructure, a shuttering for producing the next section of the cantilever structure to be concreted. This cantilever construction carb is particularly suitable for the production of double cantilevers (each overhanging a support) which are then interlocked by connecting the cantilever ends to form one unit of a bridge girder system.

It is a disadvantage of the mode of construction using such cantilever crabs, that out of every two cantilever crabs each producing a double cantilever, one must always work in the forward construction direction of the bridge and the other in the opposite direction. The special construction of this cantilever crab with a framework above the bridge deck from which is suspended a working platform located below the superstructure which carries the shuttering, is such that the space under the bridge is obstructed by this working platform, so that these carbs cannot travel past the bridge piers. For moving the crabs after the zone of the bridge lying behind has been finished, they must be disassembled, brought by land to the next support point and there re-assembled again. It is a further disadvantage that the crab can only be applied to a pier after the pier head and at least the first cantilever section have been concreted in the appropriate cantilever direction, and for carrying out this work a special shuttering is required which must either be applied to the pier or supported on the land.

This has only a slight effect on the whole production cost of a bridge when it is a question of a bridge girder system with only a few supports and large spans. However, sectional cantilever construction with such crabs is being used to an increasing degree for comparatively long multiple-span bridge girders with short spans, where accordingly the crab has to be disassembled and re-assembled more frequently.

In another known method for sectional production of bridge girder systems using cantilever construction, the cantilever crabs are formed as concreting trestles, which are suspended from trestle girders disposed above the bridge deck and are constructed so as to be able to travel on this (German Patent Specification No. 1 255 695). Here the disadvantage occurs that the weight of the concreting trestle must at least partly be taken up by the trestle girder, which is thus very heavily stressed, particularly in the middle zone of the span.

Here again there is also the difficulty that the working platform located underneath the bridge superstructure will hinder or disturb the forward travel of the crabs towards the piers.

There is also known in this connection an apparatus in which, in the rearward zone of a trestle girder spanning over at least one bridge bay and capable of travelling above the bridge superstructure, cross girders overhang, which cross girders engage round the bridge superstructure in the manner of a framework, up to the vicinity of the pier (German Patent Specification 1 243 711) The cross girders are here fixedly connected to the trestle girder and support below, the bridge superstructure, a working platform on which the shuttering rests.

SUMMARY OF THE INVENTION

It is an object of the invention to find a possible way, in an advantageous further development of the methods known from the prior art, of being able to transport a cantilever crab, spanning at least one cantilever section, from its position after finishing a cantilever into a new starting position at the particular pier following, without any hindrance from the supports.

The invention provides an apparatus for the sectional cantilever construction of bridge girder systems of reinforced or prestressed concrete comprising a closed box cross-section and superimposed laterally overhanging bridge decking, said apparatus comprising; travel devices for abutting against an already finished part of the bridge superstructure, at whose position fixed support members, e.g. hydraulic jacks are disposed during the concreting operation, longitudinal girders overhanging in the concreting condition beyond the front end of said finished superstructure part and connected to said travel devices or fixed supports therefor; shuttering components, for a cantilever section, carried by said girders; and half-frames engaging laterally round said bridge deck and having means for supporting the same on said bridge deck; the apparatus being further characterised by said longitudinal girders being arranged laterally outside the shuttering for the side walls of the super-structure and being connected with outer shuttering made inherently rigid and self-supporting; by said half-frames being connected (in such a way as to be rigidly resistant to bending) to said longitudinal girders substantially at the rearward ends of said shuttering; and by said longitudinal girders being provided at the side opposite the part which is projecting and which carries said shuttering, with devices for abutting against or supporting the underside of said laterally overhanging bridge deck.

BRIEF DESCRIPTION OF THE DRAWINGS

In the accompanying drawings:

In FIGS. 1 and 2 there is represented an apparatus which in what follows will be designated as a "cantilever construction crab" or "crab" for short. The crab 1 is shown in FIG. 1 in an insert for the production of the second section, following a support 2, of the superstructure 3 of a bridge. The superstructure 3 consists of a closed box girder with oblique main girder webs 4, a lower baseplate 5 and a deck 6 with parts 6′ widely overhanging laterally.

Figure 1:
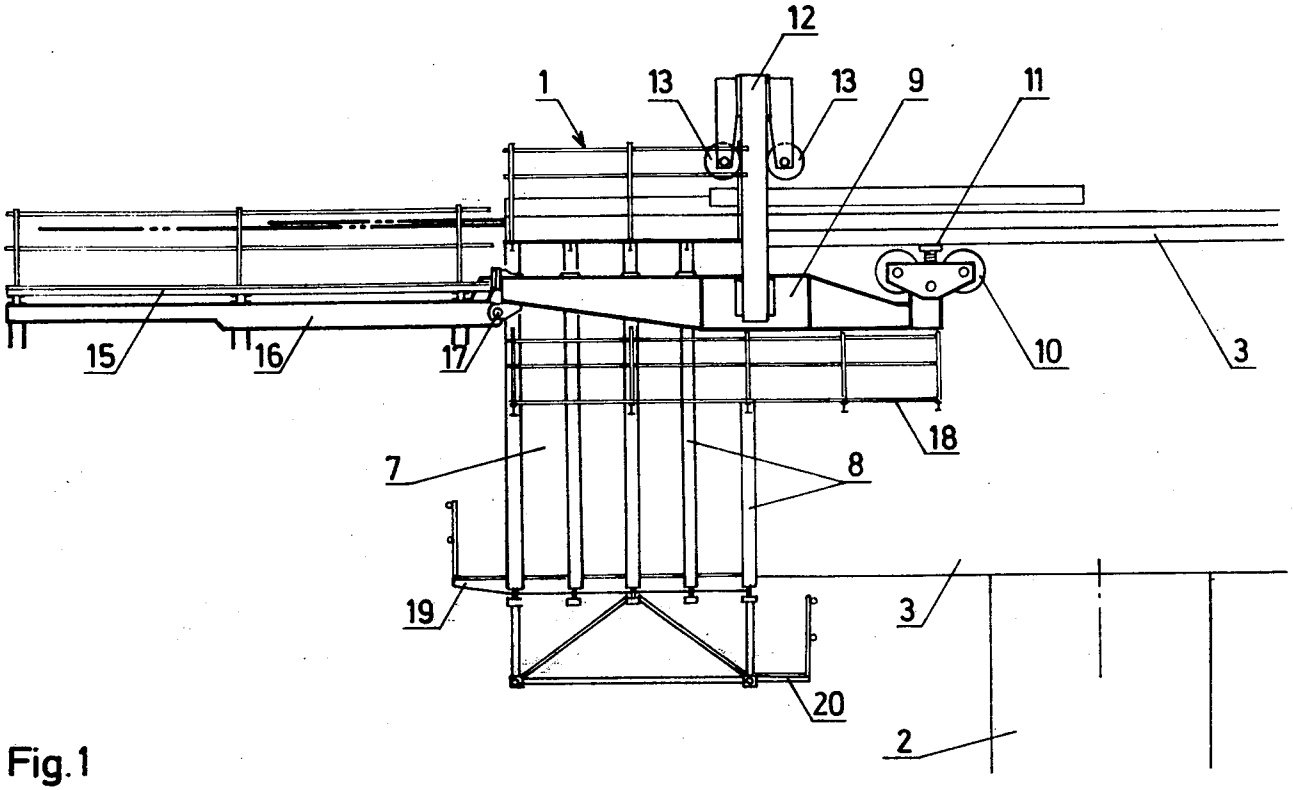
FIG. 1 is a side elevation of an apparatus in accordance with the invention.

The crab 1 itself consists of an outer shuttering 7, preferably a steel shuttering, reinforced by reinforcements 8. There are applied to the reinforcements 8, laterally in the zones below the shuttering parts for the overhanging parts 6′ of the decking 6, longitudinal girders 9, which project beyond the already finished part of the bridge superstructure 3, i.e. in a rearward At the ends opposite the projecting ends of the longitudinal girders 9, travel rollers 10 are provided, abutting against the underside of the bridge deck 6. For relieving the travel rollers 10 from load during the concreting and for equilibrating differences in height, hydraulic jacks 11 are provided.

There are further connected to the longitudinal girders 9, in such a way as to be rigidly resistant to bending, half-frames 12 laterally engaging round the overhanging parts 6′ of the deck 6, and carrying at their ends lying above the deck 6 travel rollers 13. Hydraulic jacks 14 are assigned to these travel rollers. Finally, at the end face of the crab 1 there is provided a working platform 15, which is carried by the longitudinal girder 16. This a working platform can swing down round a linkage 17. It serves for storing and preparing the reinforcing parts projecting beyond the particular cantilever section being produced. Other working platforms 18 are disposed laterally below the longitudinal girders 9; a working platform 19 is located at the end face of the crab and a working platform 20 at the rear end thereof. Working or erecting walkways 21 are provided in extensions of the overhanging parts 6′ of the deck.

Figure 3:
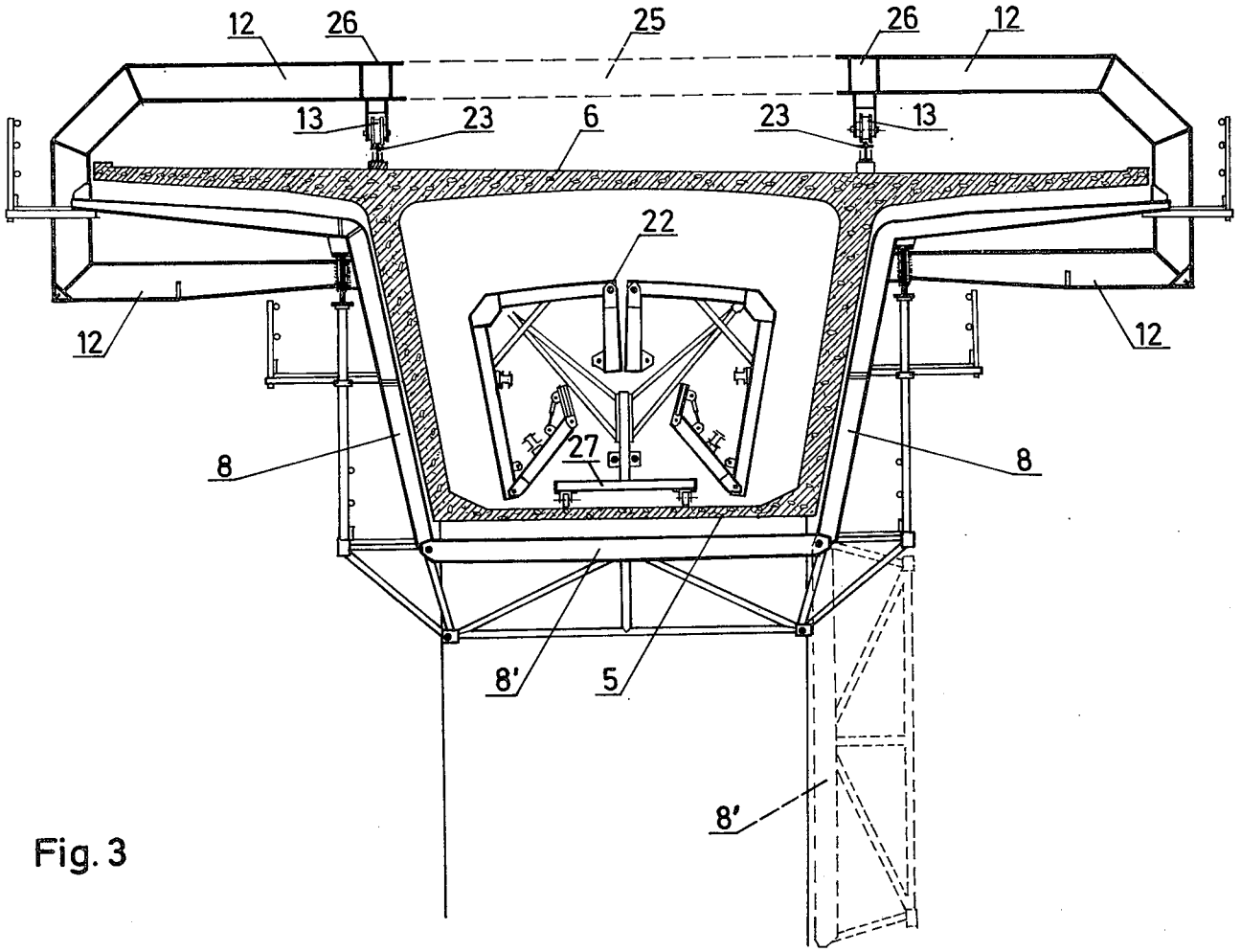
FIG. 3 in a ready-to-travel condition, in each case in a front elevation.

There is provided an inner shuttering 22 for the shuttering of the inner parts of the box girder 3, which may be formed in any manner desired. The individual parts of the inner shuttering may be made to fold together, so that even comparatively narrow apertures in the necessary cross girders can be traversed (FIG. 3).

Figure 2:
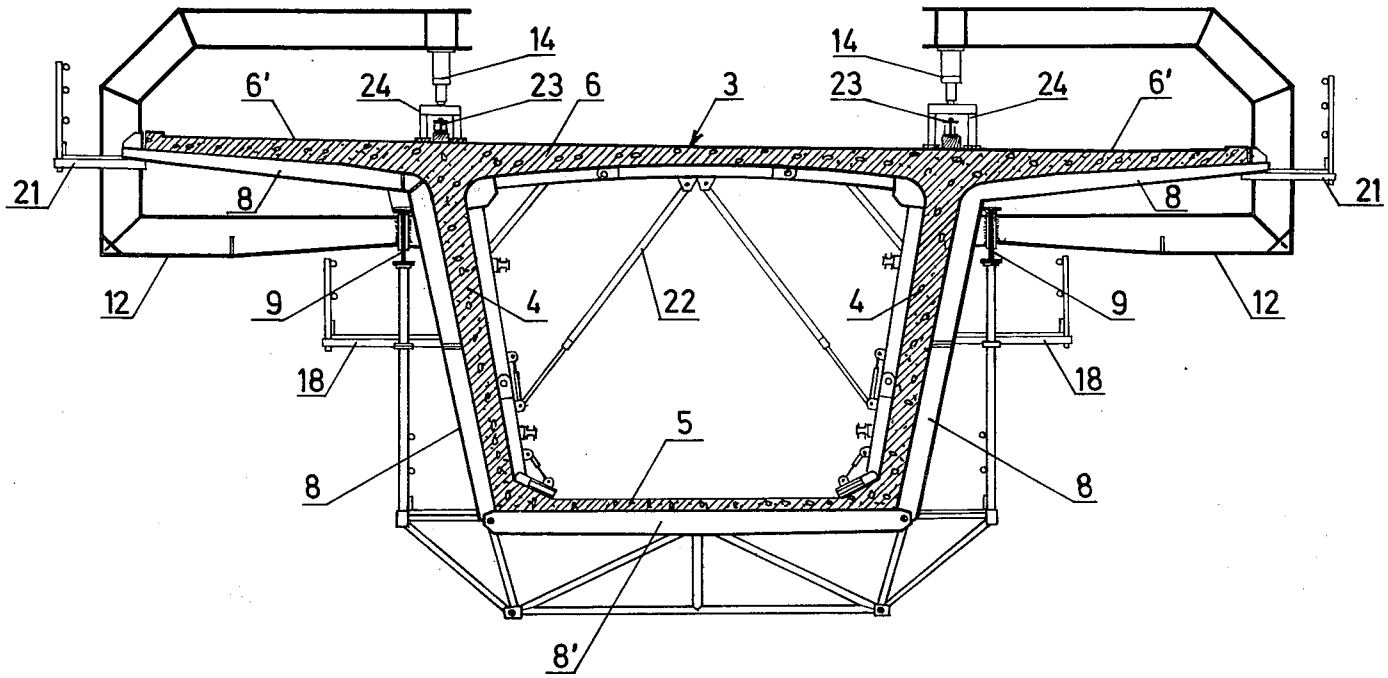
FIG. 2 shows the apparatus of FIG. 1 in a concreting condition.

In FIGS. 1 and 2 the apparatus is shown in a condition in which a cantilever section can be concreted or has just been concreted. All the shuttering parts 7 are applied against the concrete surface. The apparatus is supported by means of the hydraulic jacks 11 against the under side of the deck parts 6 and by means of the hydraulic jacks 14 against the upper surface of the deck 6, i.e. with the bridge member 24 extending over the rails 23. The individual parts of the inner shuttering 22 are also everywhere applied against the concrete cross-section.

For moving the apparatus 1 forward both the outer shuttering 7 and also the parts of the inner shuttering 22 are released from the concrete. This position is represented in FIG. 3. Simultaneously the hydraulic jacks 11 and 14 are released and the travel rollers 10 and 13 are applied on the rails 23 on the upper side of the roadway. In this condition the apparatus can be moved forward to the next cantilever section. By means of the hydraulic jacks 11 and 14 and the provision of travel rollers 10 and 13, not only is it made possible to compensate for differences in height without difficulty, but also to produce curves in the longitudinal axis of the bridge.

To allow the apparatus to travel forward past the bridge piers (as 2 in FIG. 1), the whole lower zone 8′ of the shuttering can be swung down. This condition is shown in FIG. 3 in dashed lines. In order to retain the rigidity of the apparatus 1 in this condition, there can be incorporated above the deck 6 a connecting member 25, rigidly resistant to bending, between the two ends 26 of the half-frames 12. The member 25 is also shown in dashed lines in FIG. 3. For forward travel, the inner shuttering 22 is mounted on a truck 27, which travels on the baseplate 5 of the bridge cross-section.

Figure 4:
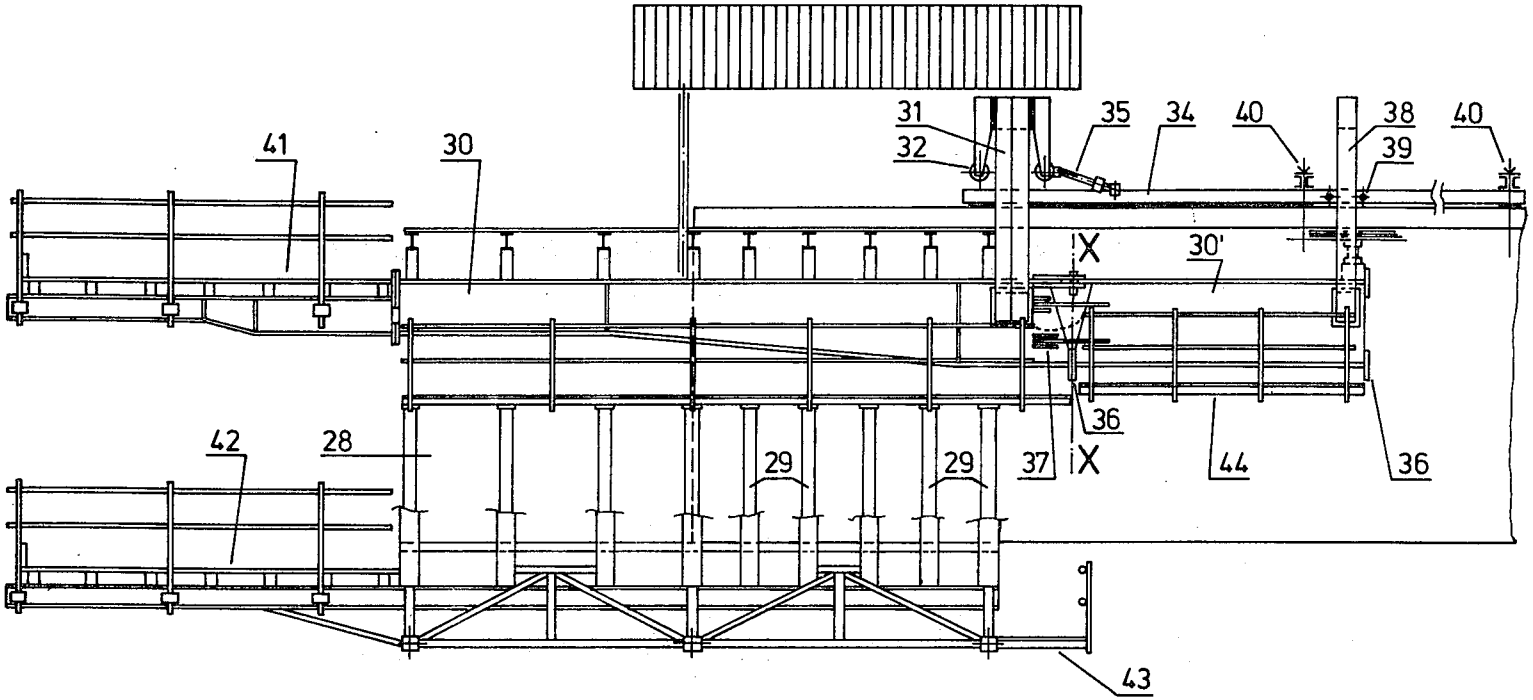
FIG. 4 shows a further embodiment of an apparatus in accordance with the invention, in side elevation.

The crab of FIGS. 4 and 5 again consists of a shuttering 28, reinforced by reinforcement members 29. Longitudinal girders 30 are applied laterally to the reinforced members 29 at the zones below the shuttering parts for the overhanging parts 6′ of the bridge deck 6. To the longitudinal girders 30 there are applied half-frames 31 engaging laterally around the overhanging parts 6′ of the bridge deck 6, and carrying at their ends lying above the deck 6 a travel mechanism comprising travel rollers 32 and hydraulic jacks 33. In the zone of this travel mechanism, which runs on a rail 34, there is provided a forward travel device consisting of an hydraulic cylinder 35 and a transporting device abutting against the rails 34.

The longitudinal girders 30 of the crab project in the rearward direction beyond the half-frames 31. The rear parts 30′ of the longitudinal girders 30 are provided with flanges 36 and are screwed to the ends 37 of the longitudinal girders 30. In addition these rearward longitudinal girder parts 30′ can swing out laterally round a vertical axis X—X.

At the end of the rearward longitudinal girder part 30′ there is disposed another pair of half-frames 38 which, like the half-frames 31, are provided with travel rollers 39. The travel rollers 39, which have to stand up to upwardly directed abutment stresses, travel laterally below the upper flanges of the rails 34, which are dead end by anchoring members 40 in the bridge deck 6.

In this crab, use is made, inter alia, of the teaching of German Patent Specification No. 1 910 197. The crab thus comprises in addition to the shuttering for the particular cantilever section being produced, the shuttering also for the next section to be concreted, in which there can already be incorporated, simultaneously with the introduction or setting of the concrete of one cantilever section, the reinforcement for the next cantilever section to be concreted. The reinforcement must of course be held during the forward travel of the crab in a manner permitting this forward travel. Furthermore this crab also comprises a set of working platform 41, 42, 43 and 44 for operating the forward travel apparatus or for carrying out necessary work.

The lower horizontal reinforcing girders 29 of the crab are divided, together with the shuttering, substantially in the longitudinal centre axis of the bridge, and connected via a releasable connecting member 45. The halves produced by the release of this connecting member can be swivelled round an articulation 46, so that the crab can travel forward to the support 2.

For the forward travel of this crab there is used an auxiliary structure represented in FIGS. 6 to 10. It comprises an auxiliary girder 47, which extends substantially the length of a bridge bay and can travel on roller blocks 48, 49 and 50. These roller blocks 48, 49 and 50 are in turn suspended from the auxiliary girder 47 in such a way as to be capable of travelling. There is further provided a fixed end block 51.

On the auxiliary girder 47 there travels a hoist in the form of a travelling winch 52 with a cable 54 running over rollers or pulleys 53. The travelling winch 52 comprises laterally overhanging parts 55 (FIG. 10), from which the half-frames 31 of a cantilever constructional crab can be suspended. The cantilevers 55 are substantially of such a length that the lateral portions existing after the division of the crab in the longitudinal centre axis can be suspended substantially from their centre of gravity. In this way a simple method of moving the crab without being affected by the piers becomes possible.

Figure 6:
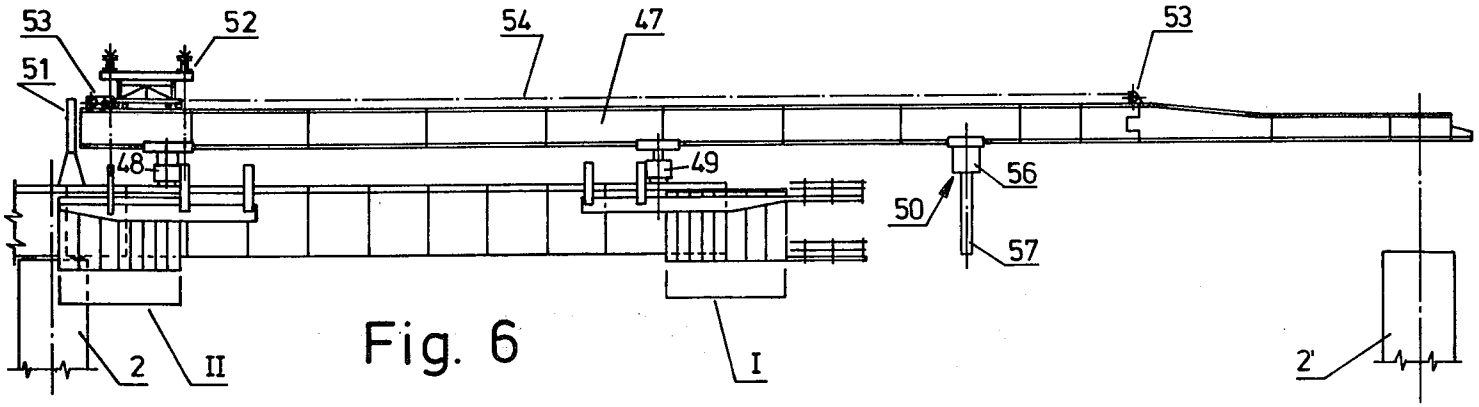
FIGS. 6 to 9 are representations of various constructional conditions in connection with the performance of two auxiliary structures and apparatus in accordance with the invention.
Figure 7:
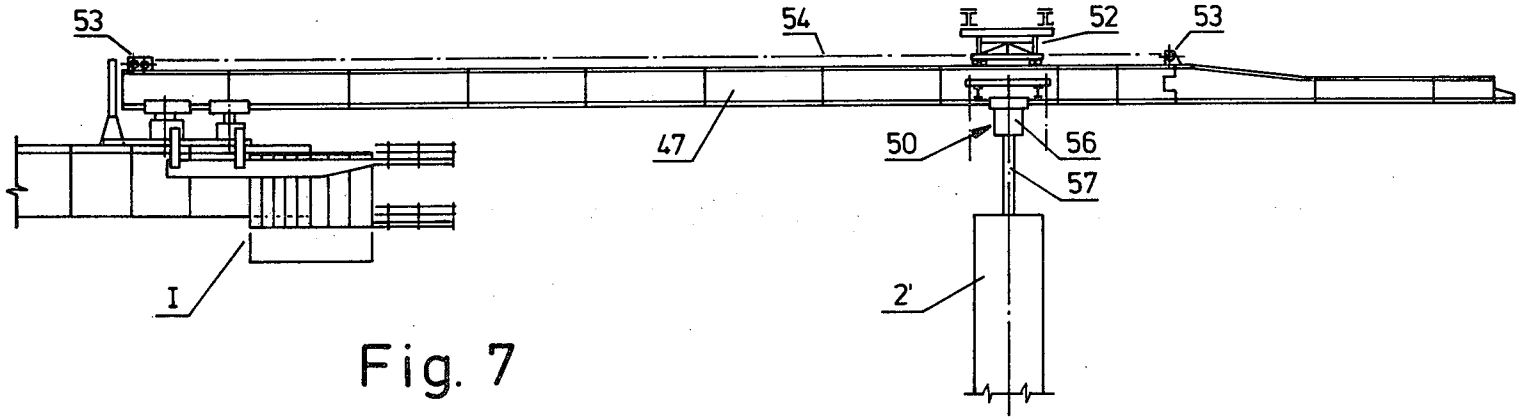

In the constructional condition represented in FIGS. 6 and 7 the cantilever constructional crab 1 working in the forward direction of construction, has already finished the overhanging part of the bridge superstructure. The crab II, working opposedly to the forward direction of construction, is still located in the rear bridge bay. The auxiliary girder 47 is supported via the blocks 48 and 49 on the cantilever and via the block 50 on the next pier 2'. The block comprises a cross girder 56, in which are inserted two pipes 57 spaced apart from one another, and the pipes are composed of individual pipe lengths.

Figure 8:
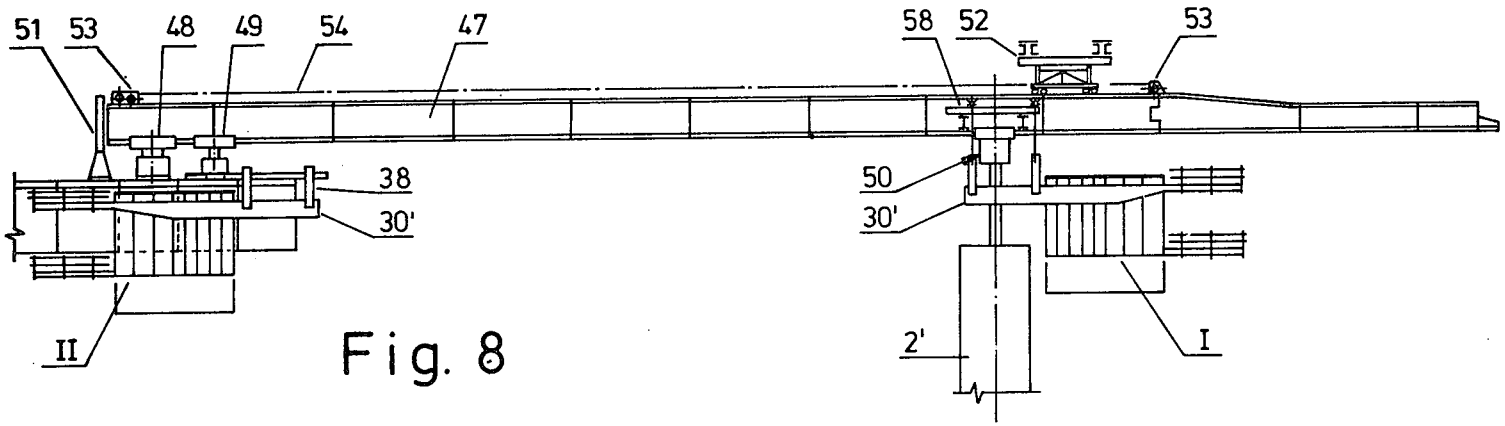
Figure 9:
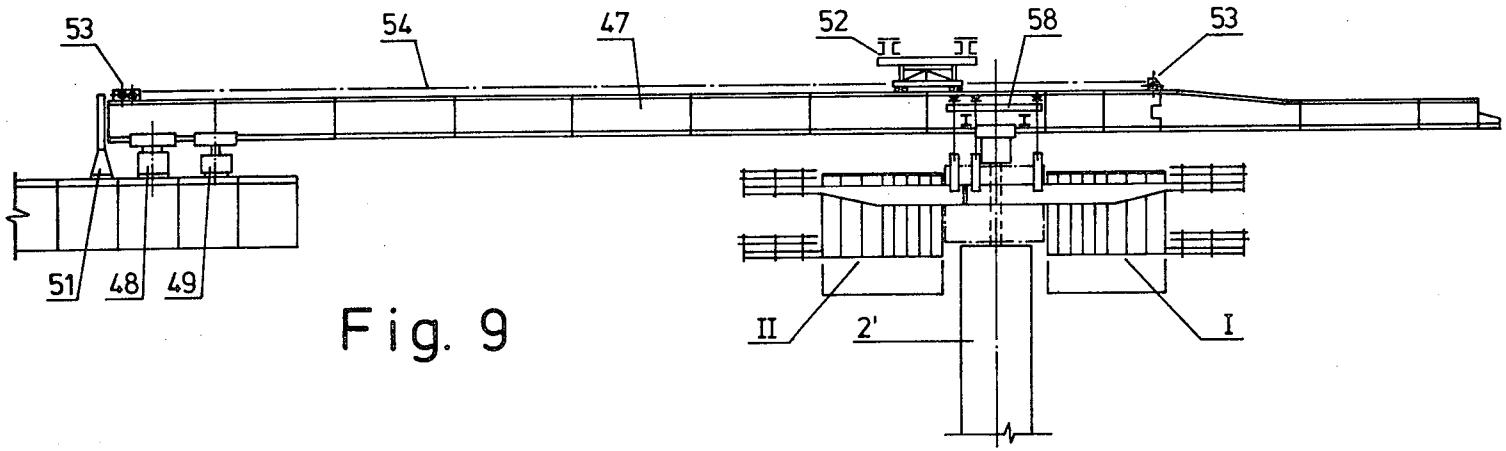
Figure 10:
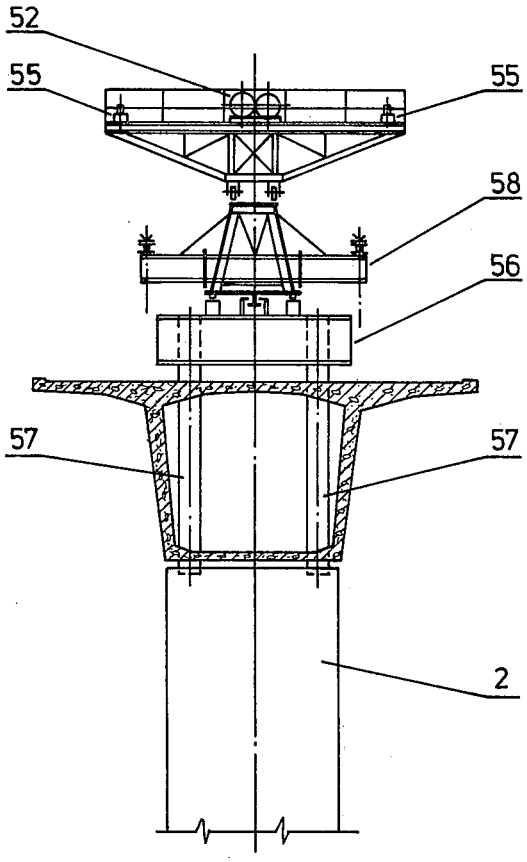
FIG. 10 is a section through an auxiliary structure.

FIG. 8 shows the condition when the crab I has already travelled forward over the pier 2', the travelling winch 52 has just deposited the crab I. It is suspended, as the bridge superstructure is still not yet finished in respect of its being placed in position, from brackets 58 fixed laterally to the auxiliary girder 47.

By means of the travelling winch 52 the crab II is then moved along, the rear part 30' of the longitudinal girder with the half-frame 38 being swung laterally out round the axis of articulation X—X. The crab II can then travel along to the existing rear part 30' of the crab I and can be coupled to this. The shuttering meanwhile extends substantially to the centre of the rearward zone 30' of the longitudinal girder 30, so that it is likewise abuttingly joined substantially in the axis of the support 2'. The crab 11 is then also suspended from the bracket 58.

In this position, first the pier head and then the particular first adjacent cantilever section concerned on each side are concreted. When this operation is finished the crab I is deposited on the bridge superstructure, its connection with the bracket 58 released and the crab I moved forward to the next bridge section. Then the rear zone 30' of the longitudinal girder 30 of the crab II is again swung in and screwed on, thus rendering this crab fully operable again per se.

Figure 13:
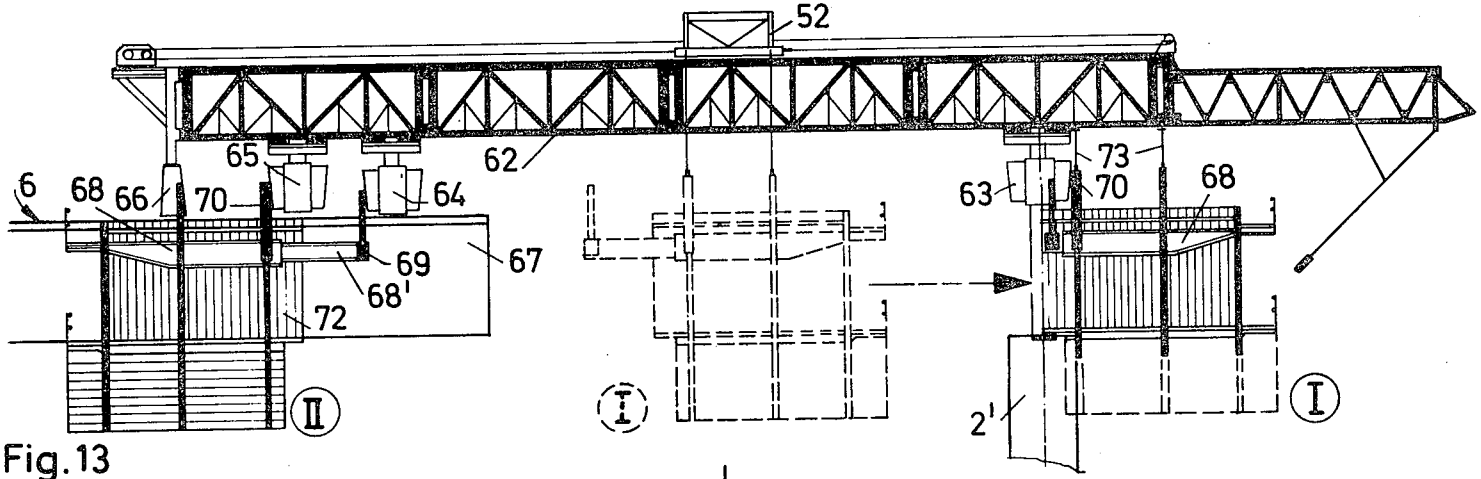
FIG. 13 represents a further embodiment of the apparatus in accordance with the invention, including an auxiliary structure, in side elevation.
Figure 14:
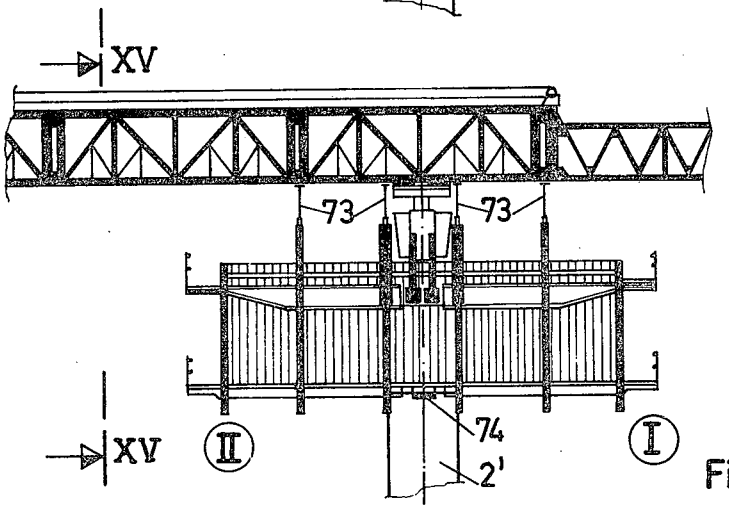
FIG. 14 shows a special setting of the apparatus.
Figure 15:
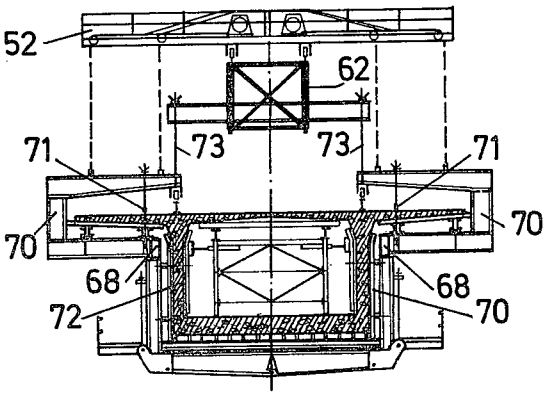
FIG. 15 is a section along the line XV—XV of FIG. 14.

FIGS. 13 to 15 the girder 62 of the Auxiliary structure for the displacement of the cantilever construction crabs I and II is formed as a lattice or truss girder. It is however supported in the same way as the girder 47 in the examples described above by a block or trestle 63 on the forward-lying pier 2' and by blocks or trestles 64, 65, 66, on the rearward-lying superstructure component 67. The structural condition represented in FIGS. 13 and 14 corresponds to that in FIGS. 8 and 9, i.e. the cantilever of the rearward-lying bay is finished and the two crabs have travelled forward to the forwardly lying support 2'.

In the cantilever construction crabs I and II, which otherwise correspond to those in the examples described above, the longitudinal girders 68 are made box-shaped; in them the rearward parts 68' are telescopically displaceable. In the extended position (crab II in FIG. 13) the rearward longitudinal girder parts 68' serve, in conjunction with the half-frames 69 disposed at their ends and at whose ends lying above the bridge deck (6) further travel rollers are disposed, together with the travel rollers disposed at the half-frames 70, for the travel of the crab on rails disposed above the bridge deck (6). In the concreting condition the ends of the rearward longitudinal girder parts 68' are supported via hydraulic presses or jacks against the under side of the overhanging deck parts 6' and thus transmit the forces of reaction arising from the loading of the overhanging forward part of the longitudinal girders 68 via the half-frames 70. These are freed from load in the concreting condition by tension members 71.

Through the telescopic displaceability of the rearward parts 68' of the longitudinal girders 68 in respect of these, and the extension of the shuttering 72 beyond the half-frame 70 by a length substantially corresponding to the width of the rearward half-frame 69, it comes about that the two crabs I and II travel together ((or, towards one another)) with their rearward ends as shown in FIG. 14. In this way a complete shuttering for the pier head, and if requisite the first adjacent cantilever section is formed without any shuttering intermediate components being required. In this condition, the two crabs I and II are suspended from the auxiliary girder 62 via tension members 73, while the shuttering components can be connected if requisite by fishplates or lashings 74.

Figure 11:
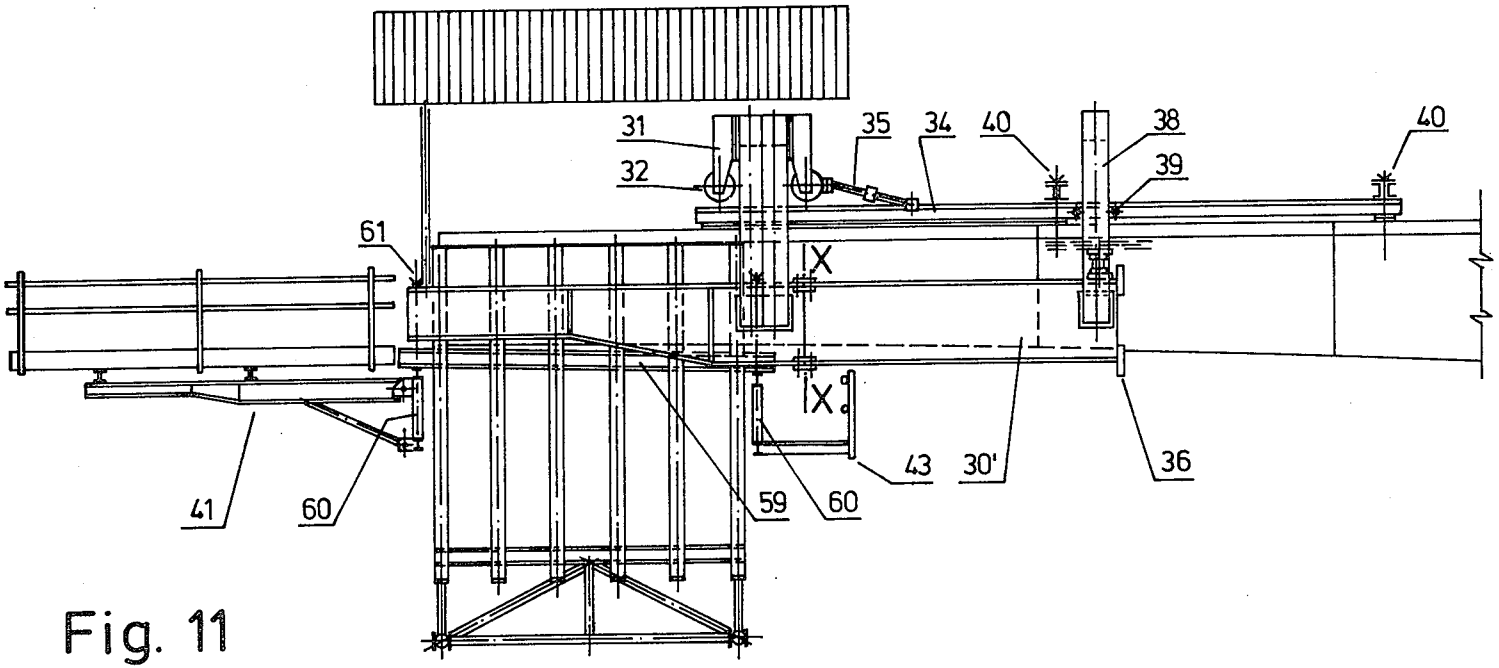
FIG. 11 shows a further embodiment of an apparatus in accordance with the invention, in which the bottom shuttering is adjustable in height, in side elevation.
Figure 12:
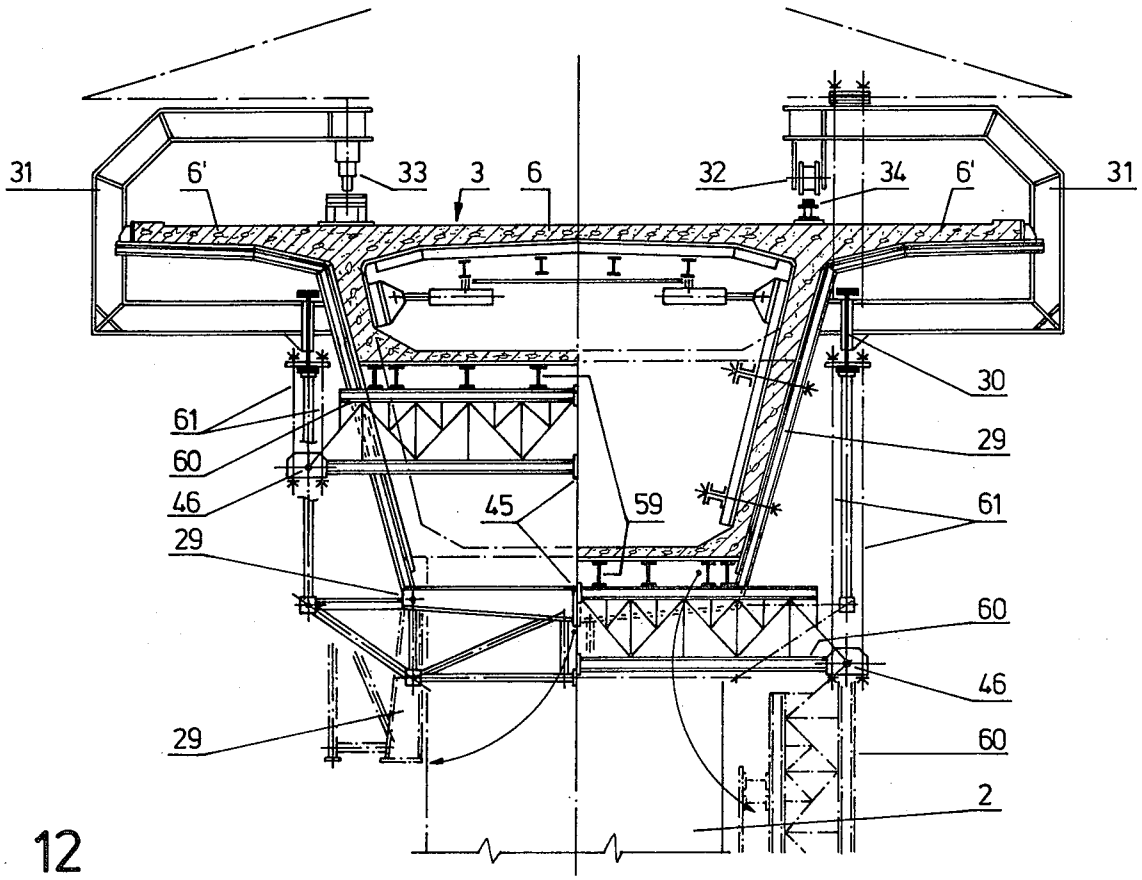
FIG. 12 shows the apparatus of FIG. 11 in two different sectional representations.

As shown in FIGS. 11 and 12, for vaulted bridges with variable web height of the cantilever constructional crab, bottom shuttering also variable in height can be formed. Here the shuttering is applied via longitudinal girders 59 on cross girders in the form of trusses 60 and can be adjusted in height via pull rods 61.

Figure 5:
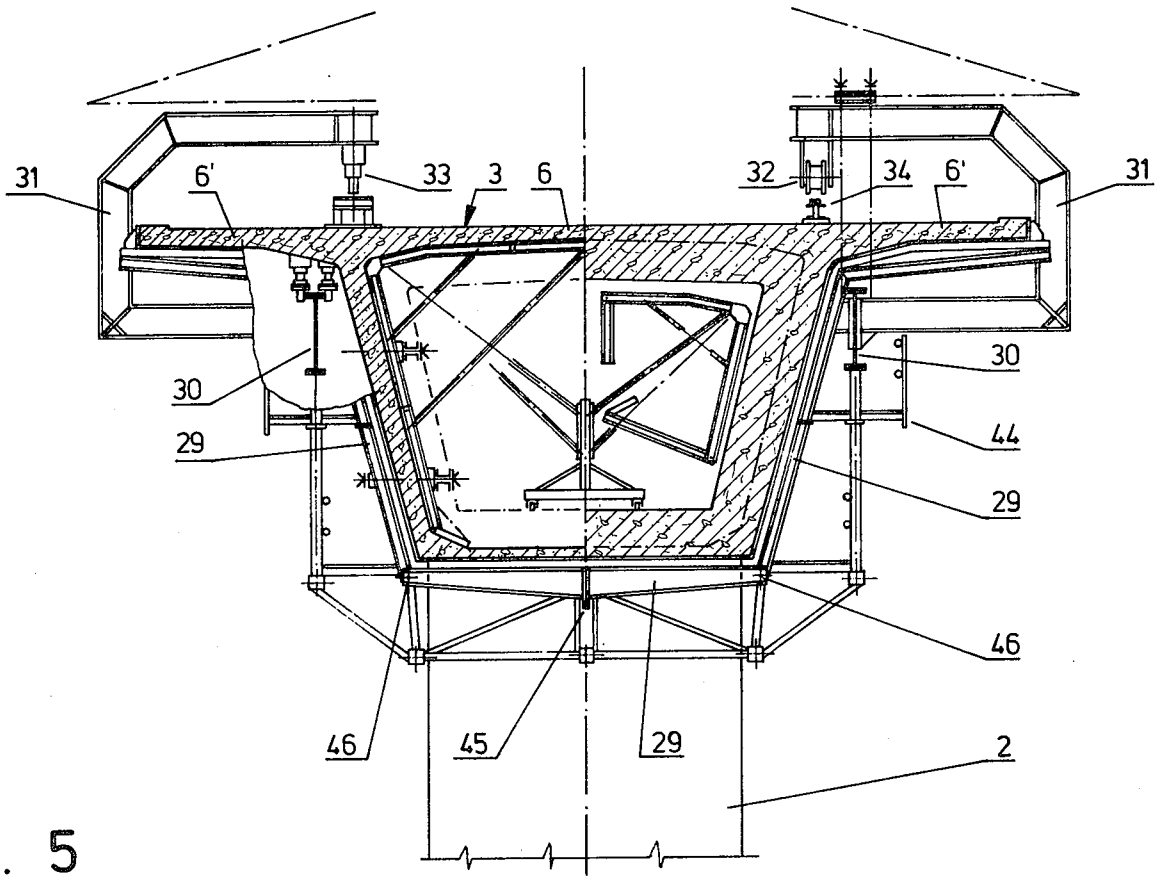
FIG. 5 shows the apparatus of FIG. 4 in two different sectional representations.

For travelling forward to the bridge supports, these cross girders 60, as in the case of the crab in FIG. 5, are divided along the longitudinal centre axis of the bridge and connected via a releasable connection member 45. Here again the two halves of the bottom shuttering are swung down round the articulation linkage 46.

The embodiments described above have the advantage that the shuttering, which in any case is necessary to give the structure to be produced its shape, does not as with known appliances of this kind exclusively form the shape and transmit its loads to any substructures, but simultaneously serves for receiving the stresses from the fresh concrete and for passing them on directly to the already finished bridge girder system. The loads occurring are here taken up in a statically and constructionally extremely advantageous manner by the travel rollers, which are either supported only at the bridge deck upper side in respect of compressive and tensile stress or at the bridge deck upper side in respect of compressive stress and at the under side in respect of counterpressure. The bending moments thus produced are taken up by the stiffening girders extending in the longitudinal direction.

The suspension of the crabs via half-frames laterally spanning the bridge girder system has the advantage that the central part of the bridge decking can be kept free in the constructional condition for the auxiliary structure, (for changing the crabs) which thus rests just above the bridge decking.

The auxiliary structure is only used for moving a crab out of the position it occupies after finishing a bay of the bridge, up to the next pier; it is only used therefore for the conveyance of the crab in the no-load condition and need not take up any concreting stresses. Thus the possibility exists, by applying two crabs against one another by the rear ends of their longitudinal girders and suspending the same from the trestle girder, of being able to produce the pier head and the first two adjacent cantilever sections in each direction, without additional equipment and shuttering. By the suspension of the crabs via brackets, direct transmission of the concreting stresses into the appropriate pier is prevented, so that here again the trestle girder is not in any case stressed by the concreting loads or stresses to the point of bending occurring.

I claim:

1. Apparatus for the sectional cantilever construction of bridge girder systems of reinforced or prestressed concrete having a superstructure comprising a closed box cross-section and superposed laterally overhanging bridge deckings, said apparatus comprising travel devices comprising a laterally spaced pair of wheel means operating on the upper surface of an already finished part of the bridge superstructure, a pair of similarly constructed longitudinal girders extending on opposite sides of the superstructure below the level of the laterally overhanging bridge deckings, a pair of half-frames extending around opposite sides of the overhanging bridge deckings and each connecting that travel device on its side of the superstructure to the longitudinal girder on its side in a region intermediate the length of the girder to carry said girders in suspended position and thereby define front portions of said girders which may be projected beyond the finished part of the superstructure and rear sides of the girders extending underneath the overhanging bridge deckings of the finished part of the bridge, jack means on the rear sides of said girders positioned to press against the undersurface of the overhanging deckings of the finished part of the superstructure, jack means associated with said wheel means of the travel devices positioned to abut against the upper surface of the finished part of the superstructure whereby to inactivate said wheel means, said jack means on the rear sides of said girders being adapted to cooperate with the jack means associated with the wheel means to fix the position of and support the apparatus, shuttering means adapted to shape at least a part of the bottom portion of said superstructure, said shuttering means comprising reinforcing means applied to the outer surfaces thereof, said shuttering means being connected to the front portion of said girders through the reinforcements, whereby during concreting, the shuttering means is supported from the longitudinal girders and said girders are supported by said jacks from the completed superstructure of the bridge.

2. The apparatus as claimed in claim 1, said rear sides of the girders also comprising roller means adapted to abut against the underside of the bridge deckings when the girders are not fixed by their jack means.

3. The apparatus as claimed in claim 1, comprising a second, rearward pair of half-frames each comprising an upper end adjacent the upper surface of the superstructure and a lower end adjacent the wider surface of the overhanging deckings, and comprising travel rollers at each of the upper ends thereof which is adjacent to the upper surface of the superstructure for supporting the second pair of half-frames on the upper side of said superstructure, said lower ends of said second pair of half-frames being connected to the pair of longitudinal girders adjacent the rear end of the latter.

4. The apparatus as claimed in claim 3, wherein the travel rollers on the upper end of the second pair of half-frames are positioned to lie slightly above the closed-box section of the superstructure.

5. The apparatus as claimed in claim 4, wherein each of said girders is made in separable front and rear sections, means for releasably connecting the rear section and the second pair of half-frames connected thereto to the front section which carries the shuttering.

6. The apparatus as claimed in claim 5, wherein the rear section of each of said girders is connected to the front section thereof for lateral swivelling.

7. The apparatus as claimed in claim 6 wherein the superstructure being formed is to extend along one or more of a series of adjacent piers, auxiliary girder means extending in the direction of the next pier of the series, means for supporting the auxiliary girder means from one end thereof on and above the surface of the already completed portion of the superstructure, means adjacent the free end of the auxiliary girder means adapted to rest on the next pier, hoist means movable along the auxiliary girder, wherein said pair of longitudinal girders is a first pair with its associated front and disconnectable rear sections, travel devices, front and rear half-frames and shuttering means, a second pair of longitudinal girders and associated means similar to said first pair, but facing in the opposite direction with respect to the finished part of the bridge structure, means to connect the hoist means to either the first or the second pair of longitudinal girders to move the same to the next concreting position, and means for coupling the rear part of the front section of said first pair of longitudinal girders to the rear part of the front section of said second set of said longitudinal girders after the rear sections of the two pairs of girders have been disconnected from the front sections thereof.

8. The apparatus as claimed in claim 1, comprising a second rearward pair of half-frames, each comprising an upper end adjacent the upper surface of the superstructure and a lower end adjacent the under surface of the overhanging deckings and comprising travel rollers at the upper end for supporting the second pair of half-frames on the upper side of said superstructure, said longitudinal girders being formed as box girders with a telescopic part axially displaceable, said second pair of half-frames being connected adjacent the lower ends thereof to the telescopically displaceable part of the girders.

9. The apparatus as claimed in claim 1, comprising at least one working platform provided in front of the front portions of said girders.

10. The apparatus as claimed in claim 1, wherein the shuttering means comprises side portions to form the outer sides and a lower horizontal portion to form the bottom of the box section of the superstructure, said lower horizontal portion comprising two sections hinged to the respective side portions and connectable along a horizontal center axis.

11. The apparatus as claimed in claim 1, wherein the shuttering means comprises side portions to form the outer sides and a lower horizontal portion to form the bottom of the box section of the superstructure, and means for adjustably mounting the lower horizontal portion to vary the depth of said box section.

12. The apparatus as claimed in claim 11, comprising cross girders connected at the ends thereof to the longitudinal girders, said lower horizontal portion being connected to the cross girders, means for adjusting the distance of the cross girders from the longitudinal girders whereby to adjust the spacing of the lower horizontal from the upper surface of the superstructure.

13. The apparatus of claim 1 wherein the superstructure being formed is to extend along one or more of a series of adjacent piers, auxiliary girder means extending in the direction of the next pier of the series, means for supporting the auxiliary girder means from one end thereof on and above the surface of the already completed portion of the superstructure, means adjacent the free end of the auxiliary girder means adapted to rest on said next pier, hoist means movable along the auxiliary girder, and means to connect the hoist means to the half-frames and connected longitudinal girders to move the same to the next cementing position.

14. The apparatus as claimed in claim 13, wherein the auxiliary girder means is formed as a box girder to resist tortional stress, and the hoist means runs along the top surface thereof, and comprising means to move the hoist means along the length of the box girder.

15. The apparatus as claimed in claim 13, wherein said means adjacent the free end of the auxiliary girder means adapted to rest on the next pier comprises a cross girder mounted adjacent the free end of said auxiliary girder, and transversely aligned pipe-like means extending downwardly from the cross-girder.

16. The device as claimed in claim 13, wherein said auxiliary girder means carries an additional set of half-frames, longitudinal girders and shuttering means, said two sets extending in opposite directions whereby the rear ends of the shuttering means of the two sets can be connected to span a new pier, one set of shuttering means extending beyond one side of the new pier and the other set of shuttering means extending beyond the other side thereof whereby the head structure for the superstructure directly above the top surface of the pier may be concreted.

* * * * *